US009847189B2

(12) United States Patent
Kim et al.

(10) Patent No.: US 9,847,189 B2
(45) Date of Patent: Dec. 19, 2017

(54) PUSH LOCK SWITCH APPARATUS FOR VEHICLE

(71) Applicants: Hyundai Motor Company, Seoul (KR); Kia Motors Corporation, Seoul (KR); SAMAS electronics. co., ltd, Seoul (KR)

(72) Inventors: Hyeon Ho Kim, Gyeonggi-do (KR); Jun Jae Lee, Gyeonggi-do (KR); Jae Hun Lee, Gyeonggi-do (KR); Hyun Ju Jung, Seoul (KR)

(73) Assignees: Hyundai Motor Company, Seoul (KR); Kia Motors Corporation, Seoul (KR); SAMAS electronics. co., ltd, Seoul (KR)

( * ) Notice: Subject to any disclaimer, the term of this patent is extended or adjusted under 35 U.S.C. 154(b) by 0 days.

(21) Appl. No.: 15/213,605

(22) Filed: Jul. 19, 2016

(65) Prior Publication Data

US 2017/0169965 A1 Jun. 15, 2017

(30) Foreign Application Priority Data

Dec. 14, 2015 (KR) ..... 10-2015-0178266

(51) Int. Cl.
*H01H 13/14* (2006.01)
*H01H 13/04* (2006.01)

(52) U.S. Cl.
CPC ..... *H01H 13/14* (2013.01); *H01H 13/04* (2013.01); *H01H 2235/01* (2013.01)

(58) Field of Classification Search
CPC ..... H01H 13/14; H01H 13/04; H01H 2235/01
USPC ..... 200/341, 520–524, 529–530, 545–558, 200/16 A–16 F, 329, 417, 449, 462–468
See application file for complete search history.

(56) References Cited

U.S. PATENT DOCUMENTS 7,009,131 B2 * 3/2006 Diep ..... H01H 13/564 200/341
8,017,883 B2 * 9/2011 Kiyono ..... H01H 13/30 200/417
8,558,131 B2 * 10/2013 Kiyono ..... H01H 13/30 200/417

FOREIGN PATENT DOCUMENTS

| | | | |
|---|---|---|---|
| JP | 2000-048675 | A | 2/2000 |
| JP | 2001-246996 | A | 9/2001 |
| KR | 10-0449957 | B1 | 9/2004 |
| KR | 10-0604653 | B1 | 7/2006 |
| KR | 2008-0082792 | A | 9/2008 |
| KR | 10-0872333 | B1 | 12/2008 |
| KR | 2013-0010367 | A | 1/2013 |
| KR | 10-1436383 | B1 | 9/2014 |

* cited by examiner

*Primary Examiner* — Edwin A. Leon
(74) *Attorney, Agent, or Firm* — Mintz Levin Cohn Ferris Glovsky and Popeo, P.C.; Peter F. Corless

(57) ABSTRACT

A push lock switch apparatus is provided. The apparatus includes a plunger that is inserted in a housing and slides and includes a moving passage in the inside thereof. A lock pin is hinged at a bottom portion of the housing and interferes with the moving passage to regulate the slide movement of the plunger. A return spring is disposed in the housing and is able to provide an elastic force to the plunger and allows the lock pin to rotate on the moving passage by pressurizing the lock pin. Additionally, a movable contactor is engaged with the plunger and slides together with the plunger and contacts a fixed terminal disposed at an outer side of the housing when the plunger slides.

6 Claims, 4 Drawing Sheets

PUSH LOCK SWITCH APPARATUS FOR VEHICLE

CROSS-REFERENCE TO RELATED APPLICATION

This application claims under 35 U.S.C. §119(a) the benefit of priority to Korean Patent Application No. 10-2015-0178266 filed on Dec. 14, 2015, the entire contents of which are incorporated herein by reference.

BACKGROUND (a) Technical Field

The present disclosure relates to a push lock switch apparatus for a vehicle, and more particularly, to a push lock switch apparatus for a vehicle that provides a cost reduction and simplified structure.

(b) Background Art

In recent years, as luxurious vehicles are manufactured, the number of electrical equipments mounted on a vehicle is greatly increasing. Accordingly, the types of switches provided to control the operations of the electrical equipment is also being diversified. A push lock switch which is mainly used is among the various types of switches. The above push lock switch is configured to execute a repeated on/off operation upon repeated pushes and is widely used for a vehicle indoor lamp, an air conditioner operation switch, various industrial apparatuses, etc. For example, a push lock switch is installed to execute the on/off operations of an indoor lamp installed within a vehicle. The push lock switch includes a knob, a plunger, a case and an upper cover having a connection terminal. A lock pin locking unit is disposed on the lower surface in the inside of the case.

The above push lock switch is assembled to an indoor lamp of a vehicle. When the plunger is pushed by the knob, the plunger maintains a forwardly moved state. At the same time, a movable ground plate of the plunger contacts a fixed ground plate of the cover and thus, electric power is supplied and the indoor lamp may be turned on. In particular, when the plunger is pushed again by the knob, the plunger will return to an initial position by the force of a return spring, and the movable ground plate of the plunger moves out of the fixed ground plate of the cover, and the electric power supply is disconnected to turn off the indoor lamp.

Such a push lock switch requires many components for the operations described above, and accordingly has a complex structure. Therefore, decreasing the number of components and simplifying a structure are important in producing a push lock switch. For the sake of the above-described functions, the push lock switch apparatus requires a lot of components, which inevitably entails complex configurations. Considering this problem, it is important to simplify the configurations to reduce the number of necessary components when manufacturing the push lock switch.

SUMMARY

The present invention provides a push lock switch apparatus for a vehicle wherein a terminal connection part disposed to contact a separate member capable of fixing the position of a lock pin, a movable contactor and a fixed terminal may be removed to integrally install a lock pin in the inside of a housing and to provide a structure which is able to contact a movable contactor and a fixed terminal using an external terminal which is engaged to a switch.

Accordingly, a cost reduction in manufacturing a switch and a simplified configuration may be obtained.

To achieve the above object, a push lock switch apparatus which may include a plunger inserted in a housing and configured to slide, wherein the plunger may include a moving passage in the inside thereof; a lock pin hinged at a bottom portion of the housing and that interferes with the moving passage, thereby regulating the slide movement of the plunger; a return spring disposed in the housing to provide an elastic force to the plunger and allow the lock pin to rotate on the moving passage by pressurizing the lock pin; and a movable contactor engaged to the plunger and configured to slide together with the plunger and contact a fixed terminal disposed at an outer side of the housing when the plunger slides.

Particularly, the plunger may include a rod disposed inside the housing, wherein an end of the rod may pass through an open portion of the housing and may be exposed to the outside, and a case formed integrally with the rod and disposed inside the housing and the case may include in the inside thereof the moving passage and a lock pin pressurizing part, the movable contactor being inserted and installed in the inside of the case.

The above movable contactor may include a fixed part inserted horizontal in the case and fixedly installed, and a contact part bent in the vertical direction at an end portion of the fixed part, wherein when the plunger descends, a protruding end portion of the contact part is exposed to the outside with the aid of an elastic force and contacts the fixed terminal. Moreover, the lock pin pressurizing part may be formed slanted to pressurize an end portion of the lock pin hooked on the moving passage and may be configured to move the end portion thereof in the clockwise direction in the inside of the moving passage.

Further, the lock pin may include an engaging part, having a first end portion hinged at a bottom portion of the housing and a second end portion positioned below the return spring, and a body part engaged integrally to the engaging part, wherein an end portion of the body part may be inserted in the moving passage, and the width of the body part may gradually decrease in the upward direction of the body part. The engaging part may have a surface thereof facing the return spring and may have a slope for an end portion of the body part to move on the moving passage as it rotates by the pressurizing force of the return spring. The fixed terminal may be engaged separable from the outside of the housing.

Since a terminal connection part which is provided to contact a separate member capable of fixing the position of a lock pin, a movable contactor and a fixed terminal may be removed to integrally install a lock pin in the inside of a housing and to provide a structure which is able to contact a movable contactor and a fixed terminal using an external terminal engaged to a switch, the present invention has an effect on a cost reduction in manufacturing a switch and a simplified configuration. For the above reasons, the assembling procedure may be simplified, and the number of necessary work processes may be reduced, so the present invention has an effect on an automated process for the manufacturing of a push lock switch apparatus.

BRIEF DESCRIPTION OF THE DRAWINGS

The above and other features of the present invention will now be described in detail with reference to exemplary embodiments thereof illustrated the accompanying drawings which are given hereinbelow by way of illustration only, and thus are not limitative of the present invention, and wherein.

Figure 1:
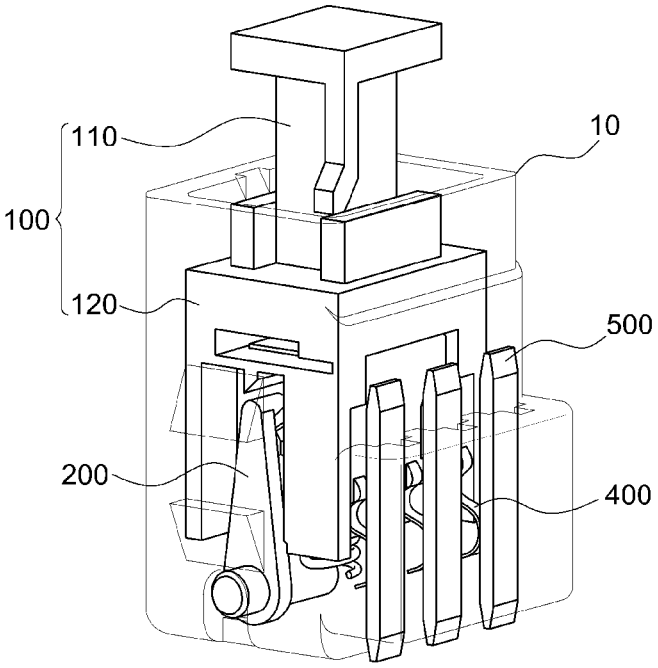
FIG. 1 is a view schematically illustrating a push lock switch apparatus for a vehicle according to an exemplary embodiment of the present invention.

It should be understood that the appended drawings are not necessarily to scale, presenting a somewhat simplified representation of various exemplary features illustrative of the basic principles of the invention. The specific design features of the present invention as disclosed herein, including, for example, specific dimensions, orientations, locations, and shapes will be determined in part by the particular intended application and use environment. In the figures, reference numbers refer to the same or equivalent parts of the present invention throughout the several figures of the drawing.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter reference will now be made in detail to various exemplary embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other exemplary embodiments, which may be included within the spirit and scope of the invention as defined by the appended claims. If any components are judged to make unclear the subject matters of the present invention, the detailed descriptions thereon will be omitted.

Figure 2:
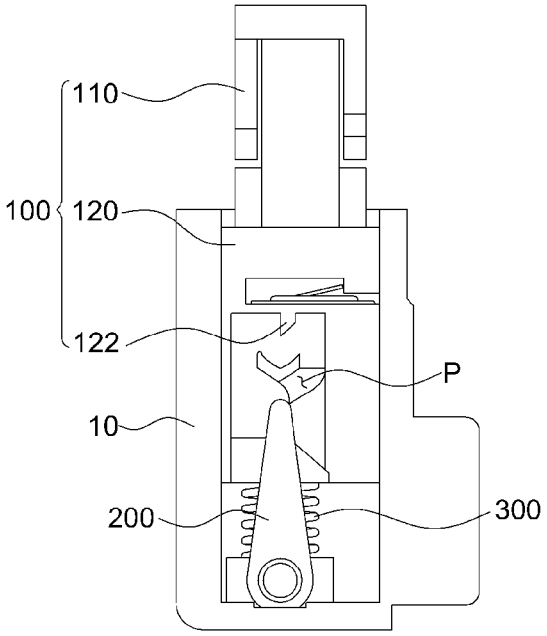
FIG. 2 is a view illustrating a free state of a lock pin of a push lock switch apparatus for a vehicle according to an exemplary embodiment of the present invention.
Figure 3:
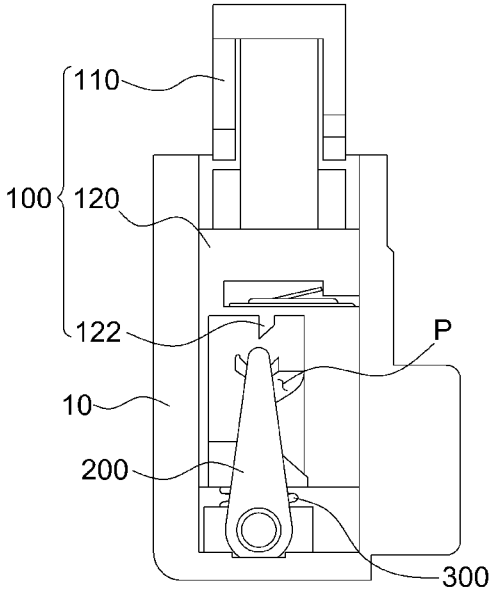
FIG. 3 is a view illustrating a locking state of a lock pin of a push lock switch apparatus for a vehicle according to an exemplary embodiment of the present invention.

FIG. 1 is a view schematically illustrating a push lock switch apparatus for a vehicle according to an exemplary embodiment of the present invention, FIG. 2 is a view illustrating a free state of a lock pin of a push lock switch apparatus for a vehicle according to an exemplary embodiment of the present invention, and FIG. 3 is a view illustrating a locking state of a lock pin of a push lock switch apparatus for a vehicle according to an exemplary embodiment of the present invention.

As illustrated in FIG. 1 and FIG. 2, the push lock switch apparatus for a vehicle according to the present invention may include a plunger 100, a lock pin 200 and a return spring 300. The plunger 100 may be inserted into a housing 10 having a predetermined inner space and may be configured to slide vertically. A moving passage "P" through which the lock pin 200 may move may be formed inside the plunger 100. The plunger 100 may be formed of a rod 110 and a case 120. The rod 110 may be connected to an operation button (not illustrated) for a switch on/off operation and may be installed inside the housing 10, wherein an end of the rod 110 may pass through an open side of the housing 10 and may be exposed to the outside.

Furthermore, the case 120 may be formed integrally with the rod 110 and may be disposed inside the housing 10. Additionally, the case 120 may include at the inside thereof the moving passage "P" and a lock pin pressurizing part 122. The lock pin 200 may be hinged at a bottom portion of the housing 10 and interferes with the moving passage "P" to regulate or adjust the slide movement of the plunger 100. When the plunger 100 slides and descends inside the housing 10, the lock pin 200 may be configured to lock the plunger 100 to regulate the sliding movement of the plunger 100.

As illustrated in FIG. 3, as the plunger 100 descends, when an end of the lock pin 200 inserted in the moving passage "P" reaches a locking position while moving along the rim of the moving passage "P", the lock pin 200 may be configured to interfere with the plunger 100 while the lock pin 200 is hooked on the moving passage "P". When the locked plunger 100 is unlocked, the plunger 100 may be configured to descend again based on an engagement (e.g., when the user pushes or presses). At this time, the lock pin pressurizing part 122 may be configured to pressurize the lock pin 200 positioned at the locking position.

The lock pin 200 may be separated from the locking position by the pressurization, and at the same time, when the plunger 100 slides by the return spring 300 and returns to an initial position, the lock pin 200 may be configured to move along the moving passage "P" upon the retuning of the plunger 100 and may be hooked and positioned at a lower end of the moving passage "P". The lock pin pressurizing part 122 may have a predetermined slope for the lock pin 200 to be separated from the locking position inside the moving passage "P" to pressurize an end of the lock pin 200.

The return spring 300 may have a predetermined length and may be disposed inside the housing 10 and may provide an elastic force when the plunger 100 slides and may allow the lock pin 200 to rotate on the moving passage "P" by pressurizing the lock pin 200. The lock pin 200 may be configured to move along an end of the moving passage "P" when rotating with the aid of the return spring 300. The above moving passage "P" may have a predetermined shape to guide the rotation route of the lock pin 200, and accordingly it may be possible to prevent the reverse direction rotation when the lock pin 200 rotates.

Figure 4:
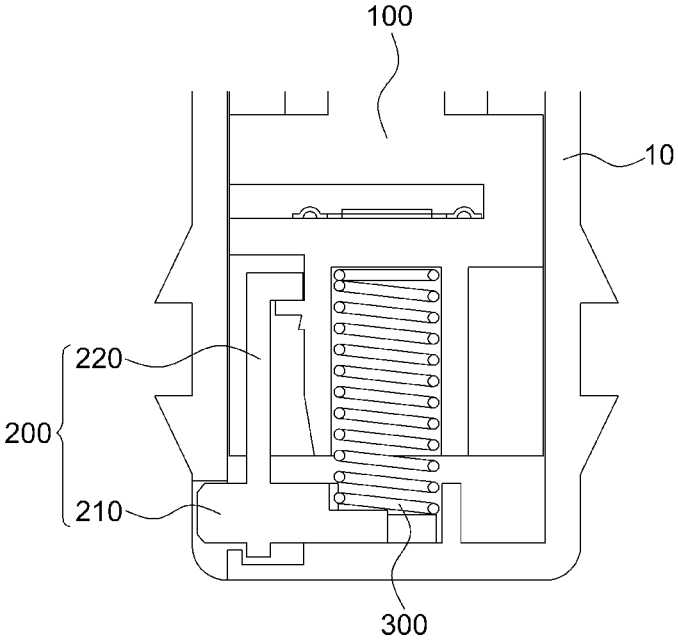
FIG. 4 is a view illustrating an engaging state of a lock pin of a push lock switch apparatus for a vehicle according to an exemplary embodiment of the present invention.
Figure 5:
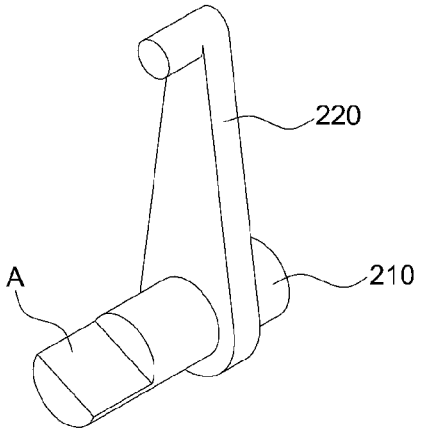
FIG. 5 is a view illustrating a shape of a lock pin of a push lock switch apparatus for a vehicle according to an exemplary embodiment of the present invention.

FIG. 4 is a view illustrating an engaging state of a lock pin of a push lock switch apparatus for a vehicle according to an exemplary embodiment of the present invention, and FIG. 5 is a view illustrating a shape of a lock pin of a push lock switch apparatus for a vehicle according to an exemplary embodiment of the present invention. As illustrated in FIG. 4, the push lock switch apparatus for a vehicle according to the present invention may include a lock pin 200.

Particularly, the lock pin 200 may include an engaging part 210 and a body part 220. The engaging part 210 may be disposed with a first end portion thereof hinged at a bottom portion of the housing 10, and a second end portion thereof may have a predetermined length and may be positioned at a lower portion of the return spring 300. More specifically, since the engaging part 210 may be hinged at a bottom portion of the hosing 10 and fixedly installed there, a separate member to fix the lock pin 200 may be omitted in the present invention.

In other words, according to the conventional apparatus, a separate leaf spring is interposed between the inner side surface of the housing 10 and the lock pin 200 to prevent the lock pin 200 from being separated from the moving passage "P". In this exemplary embodiment of the present invention, such a separate member for fixing the lock pin 200 is not necessary since the engaging part 210 may be engaged to a bottom portion of the housing 10. Accordingly, costs for manufacturing a push lock switch apparatus may be reduced.

As illustrated in FIG. 5, the engaging part 210 may have a slanted surface "A" facing the lower portion of the return spring 300 for an end portion of the body part 220 to move on the moving passage "P" as it rotates by the pressurizing force of the return spring 300. When the return spring 300 contracts as the plunger 100 slides, pressurizing force may be generated and then may be transferred to the slanted surface "A" of the engaging part 210, which consequently makes it easier for the body part 220 to move to the locking or unlocking position on the moving passage "P".

Additionally, the body part 220 may have a width thereof that decreases in the upward direction thereof, and an end portion of the body part 220 may be inserted in the moving passage "P", and the body part 220 may be integrally engaged vertical in the lengthwise direction of the engaging part 210, and an end portion of the body part 220 facing the lock pin pressurizing part 122 may be formed to be round.

Figure 6:
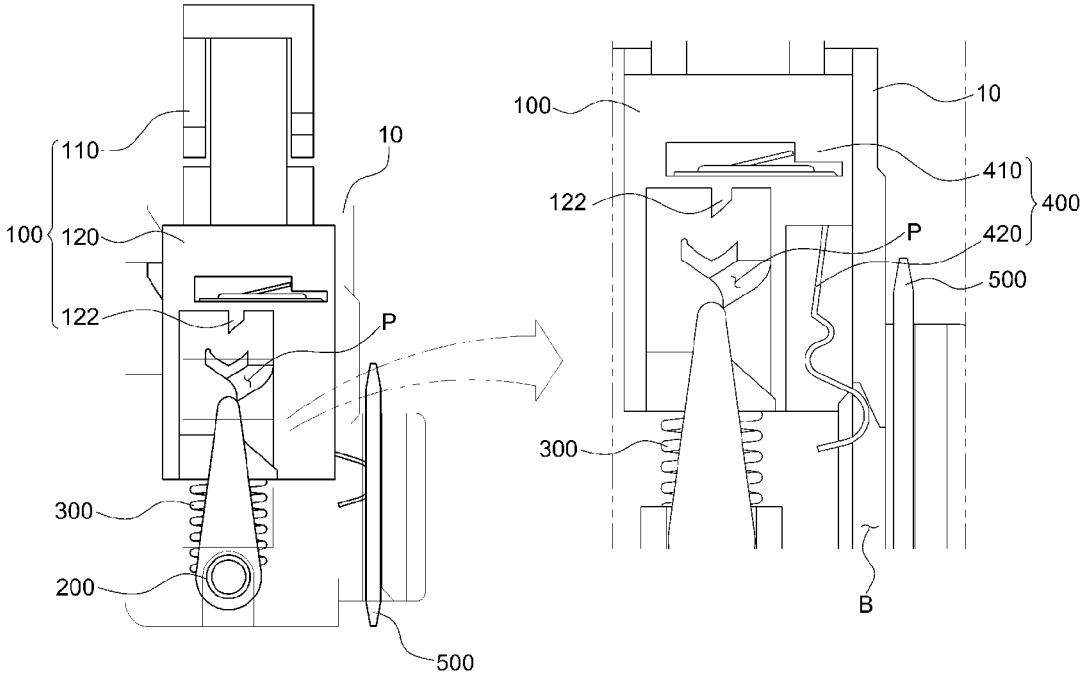
FIG. 6 is a view illustrating a movable contactor in a free state in a push lock switch apparatus for a vehicle according to an exemplary embodiment of the present invention.
Figure 7:
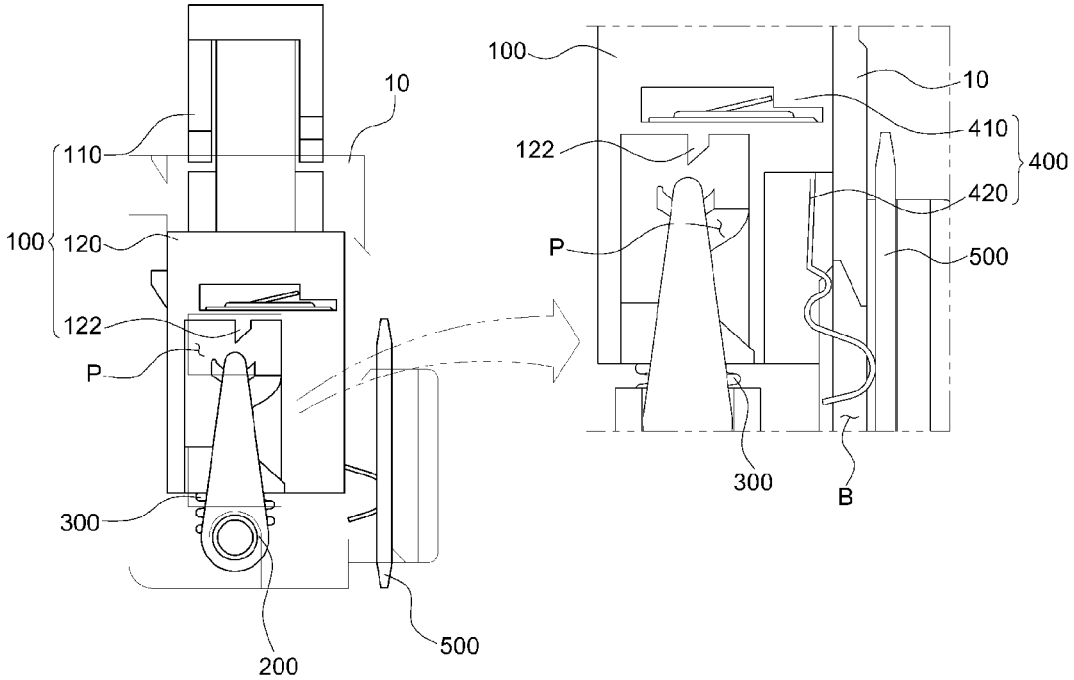
FIG. 7 is a view illustrating a movable contactor in a pressing state in a push lock switch apparatus for a vehicle according to an exemplary embodiment of the present invention.

FIG. 6 is a view illustrating a movable contactor in a free state in a push lock switch apparatus for a vehicle according to an exemplary embodiment of the present invention, and FIG. 7 is a view illustrating a movable contactor in a pressing state in a push lock switch apparatus for a vehicle according to an exemplary embodiment of the present invention. As illustrated in FIG. 6, the push lock switch apparatus for a vehicle according to the present invention may include a movable contactor 400.

Particularly, the movable contactor 400 may be engaged with the plunger 100 and may be configured to slide together with the plunger 100 and may contact the fixed terminal 500 disposed at an outer side of the housing 10 when the plunger 100 slides. For this operation, the movable contactor 400 may include a fixed part 410 and a contact part 420. The fixed part 410 may be inserted in the horizontal direction into the case 120 and may be fixedly installed. Further, the fixed part 410 may be installed elastically. That is, the fixed part 410 may be inserted in an insertion space (not illustrated) formed in the case 120 when one surface thereof is compressed. After the fixed part 410 is inserted, is the fixed part 410 may be unfolded by the elasticity and may be fixed inside the case 120. The contact part 420 may be formed bent in the vertical direction at an end portion of the fixed part 410 and may be made of an elastic material to allow an end portion of the contact part 420 which protrudes when the plunger 100 descends to be exposed to the outside by the elasticity and to contact the fixed terminal 500.

The pressing operation of the push lock switch apparatus for a vehicle according to the present exemplary embodiment will be described with reference to FIG. 7. As the plunger 100 slides in the inside of the housing 10 and descends, the movable contactor 400 may be configured to descend. The contact part 420 may descend with an end portion thereof contacting an inner side surface of the housing 10. When the contact part 420 descends down to the opening "B" open at an inner side surface of the housing 10, the contact part 420 may be exposed to the outside of the opening "B" with the aid of elasticity.

Additionally, an inner side surface of the housing 10 having the opening "B" may be formed slanted for the end portion of the contact part 420, which has been formed round, to slide with the aid of the slope and to be exposed to the outside of the opening "B". The end portion of the contact part 420 which has been exposed to the outside of the opening "B" may contact the fixed terminal 500 disposed at an outer side of the housing 10, and accordingly the push lock switch apparatus may be turned on. The fixed terminal 500 may be fixedly installed at an outer side of the housing 10. Alternatively, the fixed terminal 500 may be installed detachable at an outer side of the housing 10 together with a cover (not illustrated). Accordingly, it may satisfy various circuit conditions, if necessary.

Consequently, the present exemplary embodiment of the present invention may have an effect on a reliable contact between the movable contactor 400 and the fixed terminal 500 using the above-described structure. Since the exemplary embodiment does not require physically transformation of the shape of the movable contactor 400 as in the conventional apparatus, it may be possible to manufacture an environmentally friendly push lock switch apparatus. In the present exemplary embodiment of the present invention, the plunger 100, the lock pin 200, the return spring 300 and the movable contactor 400 may be assembled more easily, to ensure that the number of work processes may be reduced. Therefore the push lock switch apparatus may be manufactured by an automated process.

In the present invention, since a terminal connection part provided to contact a separate member capable of fixing the position of a lock pin, a movable contactor and a fixed terminal may be removed to integrally install a lock pin in the inside of a housing and to provide a structure which is able to contact a movable contactor and a fixed terminal using an external terminal engaged to a switch, the present invention has an effect on a cost reduction in manufacturing a switch and a simplified configuration. For the above reasons, the assembling procedure may be simplified, and the number of necessary work processes may be reduced, so the present invention has an effect on an automated process for the manufacturing of a push lock switch apparatus.

The invention has been described in detail with reference to exemplary embodiments thereof. However, it will be appreciated by those skilled in the art that changes may be made in these exemplary embodiments without departing from the principles and spirit of the invention, the scope of which is defined in the appended claims and their equivalents.

What is claimed is:

1. A push lock switch apparatus for a vehicle, comprising:

a plunger inserted in a housing and configured to slide, wherein the plunger includes a moving passage in the inside thereof;

a lock pin hinged at a bottom portion of the housing and configured to interfere with the moving passage to regulate the slide movement of the plunger;

a return spring disposed in the housing to provide an elastic force to the plunger and is configured to allow the lock pin to rotate on the moving passage by pressurizing the lock pin; and a movable contactor engaged with the plunger and configured to slide together with the plunger and contact a fixed terminal disposed at an outer side of the housing when the plunger slides, wherein the plunger include:

a rod disposed inside the housing, wherein an end of the rod passes through an open portion of the housing and is exposed to the outside; and a case formed integrally with the rod and disposed inside the housing and includes, in the inside thereof, the moving passage and a lock pin pressurizing part, the movable contactor being inserted and installed in the inside of the case.

2. The apparatus of claim 1, wherein the movable contactor includes:

a fixed part inserted horizontally in the case and fixedly installed; and a contact part formed bent in the vertical direction at an end portion of the fixed part, wherein when the plunger descends, a protruding end portion of the contact part is exposed to the outside by an elastic force and contacts the fixed terminal.

3. The apparatus of claim 1, wherein the lock pin pressurizing part is formed slanted to pressurize an end portion of the lock pin hooked on the moving passage and to move the end portion thereof in the clockwise direction in the inside of the moving passage.

4. The apparatus of claim 1, wherein the lock pin includes:

an engaging part having a first end portion hinged at a bottom portion of the housing, and a second end portion positioned below the return spring; and a body part engaged integrally to an engaging part, wherein an end portion of the body part is inserted in the moving passage, the width of the body part gradually decreases in the upward direction of the body part.

5. The apparatus of claim 4, wherein the engaging part is configured with a surface thereof facing the return spring has a slope for an end portion of the body part to move on the moving passage as it rotates by the pressurizing force of the return spring.

6. The apparatus of claim 1, wherein the fixed terminal is engaged separable from the outside of the housing.

* * * * *